US005768886A

United States Patent [19]

Wang et al.

[11] Patent Number: 5,768,886

[45] Date of Patent: Jun. 23, 1998

[54] TWIN-PLATE FLAMEHOLDER CONSTRUCTION

[75] Inventors: Muh-Rong Wang; Wei-Hsiang Lai, both of Tainan, Taiwan

[73] Assignee: National Science Council, Taipei, Taiwan

[21] Appl. No.: 537,097

[22] Filed: Sep. 29, 1995

[51] Int. Cl.[6] ..... F02K 3/10

[52] U.S. Cl. ..... 60/261; 60/749; 110/322

[58] Field of Search ..... 60/291, 749, 270.1; 110/322, 323, 327

[56] References Cited

U.S. PATENT DOCUMENTS

| | | | |
|---|---|---|---|
| 2,936,585 | 5/1960 | Worsham et al. | 60/749 |
| 2,994,287 | 8/1961 | Freiday | 110/322 |
| 3,765,178 | 10/1973 | Hufnagel et al. | 60/749 |
| 4,072,008 | 2/1978 | Kenworthy et al. | 60/261 |
| 4,592,200 | 6/1986 | Benoist et al. | 60/749 |
| 4,730,453 | 3/1988 | Benoist et al. | 60/261 |
| 4,751,815 | 6/1988 | Moore | 60/261 |

*Primary Examiner*—Charles G. Freay
*Attorney, Agent, or Firm*—Beveridge, DeGrandi, Weilacher & Young, LLP

[57] ABSTRACT

This invention is a twin-plate flameholder for an afterburner and reheater of jet engines as well as for industrial burners and incinerators. The flameholder features two plates with a certain overlap and a slit at the overlap portion. A small portion of the air and fuel flows through the slit between the two plates and results in a significant modification in the aerodynamic flow structure and local fuel distribution to enhances the capability of flameholding. Hence the performance of the flameholder is much better than conventional ones in terms of combustion efficiency, flame ignition, blowout limits, and operation range of the combustion devices. The inclined angle of the twin-plate flameholder can be adjusted by a turning mechanism to adjust the inclined angle of the twin-plate flameholder under different operation conditions. Furthermore, a series of the twin-plate flameholders can be linked together with a control mechanism so that these flameholders can be rotated in the same or opposite direction. Finally, the claimed mechanism can be utilized in the industrial burners and incinerators to enhance their combustion performance and to discharge ash or incidental clog.

18 Claims, 9 Drawing Sheets

PRIOR ART

PRIOR ART

O) Overlap length

S) slit size

D) extension at the trailing edge

TWIN-PLATE FLAMEHOLDER CONSTRUCTION

BACKGROUND OF THE INVENTION

1. Field of the Invention

The present invention relates to flameholders applied to afterburners and reheaters of jet engines as well as to industrial burner and incinerators. More particularly, the present invention relates to twin-plate flameholder construction which has better performance than that of the conventional ones in terms of the combustion efficiency, flame ignition and blowout limits as well as operation range of the combustion devices.

2. Description of the Related Prior Art

There are three methods commonly used for stabilizing the flame in a combustion chamber of industrial burners, namely: A. using a swirler to produce recirculation; B. using sudden enlarged duct at the joints of two ducts having different dimensions to produce recirculation; and C. using bluff body such as cylinder to produce recirculation. These prior art devices are shown in FIG. 1A.

There are also other methods including the use of a reversing stream and porous plate etc. to create a combustion flow region. Object or objects used to hold the flame stable are all to be referred as 'FLAMEHOLDER'.

To meet the requirements of an air-fighter of fast take-off and climbing as well as other tactical operations, usually its turbine engines are equipped with afterburners which enable the engine to boost its thrust force by a large scale within a moment. The afterburner mainly consists of a casing, liner, diffuser, fuel spray bars and flameholders. With this arrangement, the afterburner can boost its thrust force within a moment with a limited weight increase and, therefore, it has been widely adopted by military jet engines. Since the velocity of gases exhausting from the main combustion chamber far exceeds the velocity of spray burning, a flame holding mechanism is required to keep the flame in stable. The flame holding mechanism in these afterburners are a bluff body flameholder, mostly designed as V-gutter. While facing a stream, a recirculation zone is formed due to the blockage and hence the fuel is allowed to extend its residence time at this low speed region so as to hold the flame in stable burning states. This is the major principle of V-gutter flameholder as shown in FIG. 1B.

Since 1950, USA has extensively engaged in the study of the V-gutter flameholder, and until now, all the designs applied to a flameholder in an afterburner of turbine engines are mostly V-gutter in shape. For example, the study made in literature by A. H. Lefebvre in 1988 suggested various kinds of slots formed on a V-gutter construction which concluded as no significant improvement from those designs. On the part of patent priorities, U.S. Pat. No. 2,702,452 issued to TAYLER in February of 1955 and U.S. Pat. No. 3,315,468 issued to VDOVIAK in April of 1967 all adopted V-gutter flameholder as a major construction of its afterburner. In 1973, U.S. Pat. No. 3,747,345 issued to MARKOWSKI in June of 1973 proposed a swirler type afterburner. It was claimed that this design could shorten the length of an afterburner. However, for some reason its actual products did not meet their expectations. U.S. GE Company is in possession of the following two patents; U.S. Pat. No. 3,931,707 issued to VDOVIAK in January of 1976 and U.S. Pat. No. 3,765,178 issued to HUFNAGEL et al. in October of 1973. These are designed by combining traditional V-gutter flameholder with swirler type afterburner and was firstly applied to J85 turbine engine. In that, it was characterized by having a V-gutter flameholder as main flame holding mechanism with an opening at its leading edge to allow a small amount of air which is guided by swirler to come into flameholder. This design was claimed to have made improvement on flame stability. At a later date, GE applied this design to F404 turbine engine. The TFE 1042 engine developed from a joint-venture between the Chung-Shang Institute of Science and Technology of ROC and US Garrett also adopted the above design. U.S. Pat. No. 4,185,458 issued to ERNST in January of 1980 suggested a flameholder by combining V-gutter flameholder in circumferential and radial directions, and applied to a series of turbine engines manufactured by P&W Company.

There are also other studies made on the flameholder construction such U.S. Pat. No. 3,800,527 issued to MARSHALL et al. in April of 1974; U.S. Pat. No. 4,134,260 issued to LEFEBVRE et al. in January of 1979; U.S. Pat. No. 4,315,401 issued to BEAL et al. in February of 1982; U.S. Pat. No. 4,490,973 issued to KINSEY in January of 1985 and U.S. Pat. No. 4,815,283 issued to ELDREDGE et al in March of 1989. All these studies intended to improve combustion efficiency through modification and additions which merely made its V-gutter flameholder more complicated and its configuration of construction still remained a V-qutter.

The plate type flameholder has been studied in the literature. For example, Gruzdev et al. studied the single-plate type flameholder in 1981. They found that, under the same hydraulic resistance (blockage ratio), it is possible to reduce the weight of the flameholder significantly without degrading the fuel distribution efficiency. These results were attributed to the increase of the burning velocity and blow-out limit.

The idea of using a controllable flat-plate as a flameholder stems from the advantages of its capability to control the flat-plate angle and light weight. This is especially useful in modern afterburner design. The easy control capability allows it to change the blockage ratio as engine thrust rating varies during the flight. The flat plate flameholder can be controlled to the direction parallel to the air-steam during dry power engine operation to reduce pressure loss. The blockage ratio and the inclined angle can be adjusted to meet high power output requirement in normal and combat conditions. The aerodynamic characteristics and the combustion performance of the flat-plate flameholder are hence studied.

Theoretically, recirculation produced from blockage by a bluff body should have a fixed ratio. Based on this principle, inventors proposed in their ROC Pat. No. 56104 an adjustable single plate flameholder in 1992 which proved that an increase in the angle-of-attack (AOA) of single-plate results in the increase of the pressure drop across the single-plate flameholder and increases the combustion efficiency, as well as extending the flame stability limits as compared to those of the conventional V-gutter. Furthermore, this type of flameholder has the advantage of easy control in changing the AOA to satisfy the different operational conditions.

In a later study, inventors further suggested in 1994 a design of a flameholder with a slit stream through the path between two plates to increase the fuel concentration in the wake zone. A modified twin-plate flameholder was hence designed.

SUMMARY OF THE INVENTION

The reason for most of afterburner to use a V-gutter flameholder is mainly to take the advantage of its simple construction. Somehow, it has drawbacks, for example, it is very sensitive to the variation of stream flow such as disturbance caused by the accelerated mass flow and undesirable fuel distribution, etc. All those will affect the flame to be easily blowout.

The flame is easily blowout in the high altitude because of its relatively low pressure and low temperature. Therefore, there is a limitation imposed on aircrafts in terms of its flight envelope and it is not easy to reach a flight regime in high altitude with low speed. In order to extend its flight envelope, there is a relatively high requirement on the stability of the combustor used in the system.

Regarding to the operational feature of a fighter's engine equipped with afterburner, although the afterburner can enhance thrust force during operation, this momentous thrust force can only be used during fast take-off and tactical operations such as chasing and escaping due to its high specific fuel consumption rate. On the other hand, with the existence of this flameholder in its system, the engine will suffer some inevitable pressure loss during the other 90% of dry power and thus its normal thrust force is reduced.

The object of this invention is to provide a twin-plate flameholder construction to eliminate the above mentioned drawbacks as well as to improve combustion efficiency.

The further object of this invention is to provide a twin-plate flameholder construction which allows a small portion of air and fuel to flow through a slit between two plates which will result in a significant modification of the aerodynamic flow structure and local fuel distribution to enhance the capability of flameholding.

Still a further object of this invention is to provide a twin-plate flameholder construction with much better performance than the conventional ones in terms of combustion efficiency, flame ignition, blowout limits and operational range of a combustion device.

The inclined angle of the twin-plate flameholder can be adjusted by a turning mechanism, that will provide the benefit of adjusting the inclined angle of twin-plate flameholder under different operational condition.

Furthermore, a series of twin-plate flameholders can be linked together with a control mechanism, so that, these flameholders can be rotated in the same or opposite directions.

Finally, this invention can also be applied to any industrial burners and incinerators to enhance their combustion performance.

BRIEF DESCRIPTION OF THE DRAWINGS

The objects and advantages of the present invention will become more apparent from the following detailed description and preferred embodiments when read in connection with the accompanying drawings, in which.

REFERENCE NUMBER OF THE ATTACHED DRAWINGS

Figure 1:
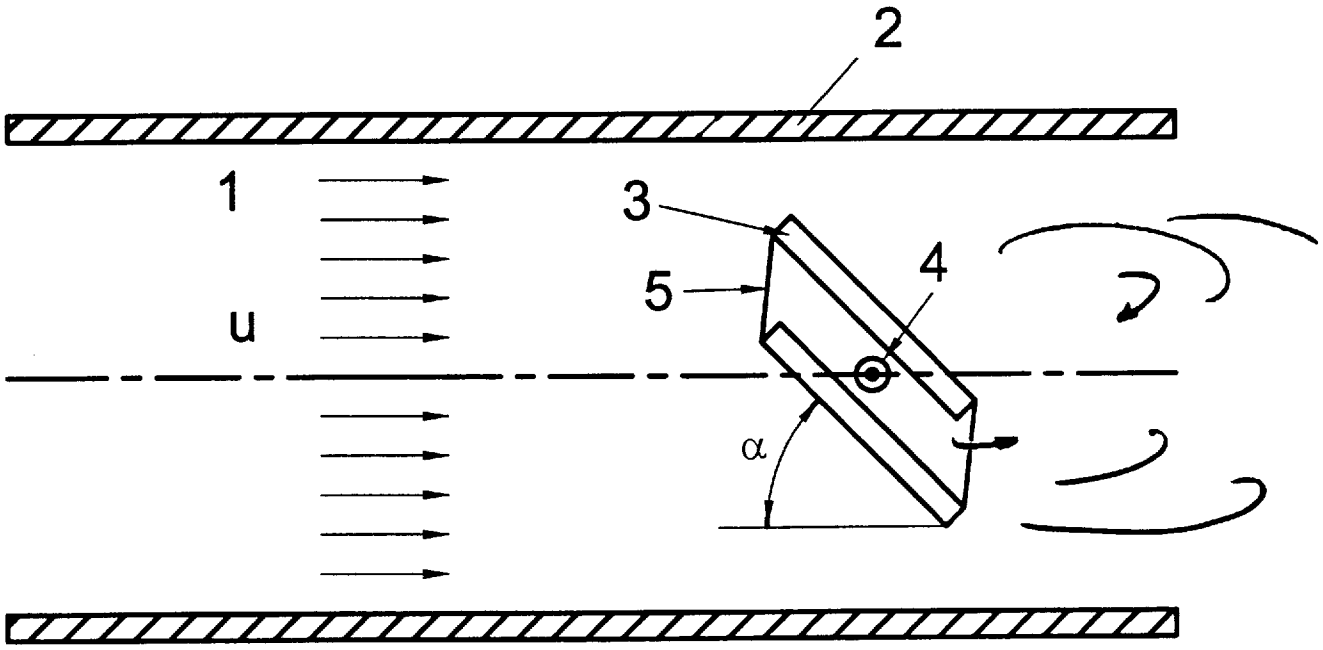
FIG. 1 is a section view showing the twin-plate flameholder according to this invention in a two-dimensional stream flow, in which, this flameholder can be rotated to any angle required in relation to the stream direction.
Figure 1A:
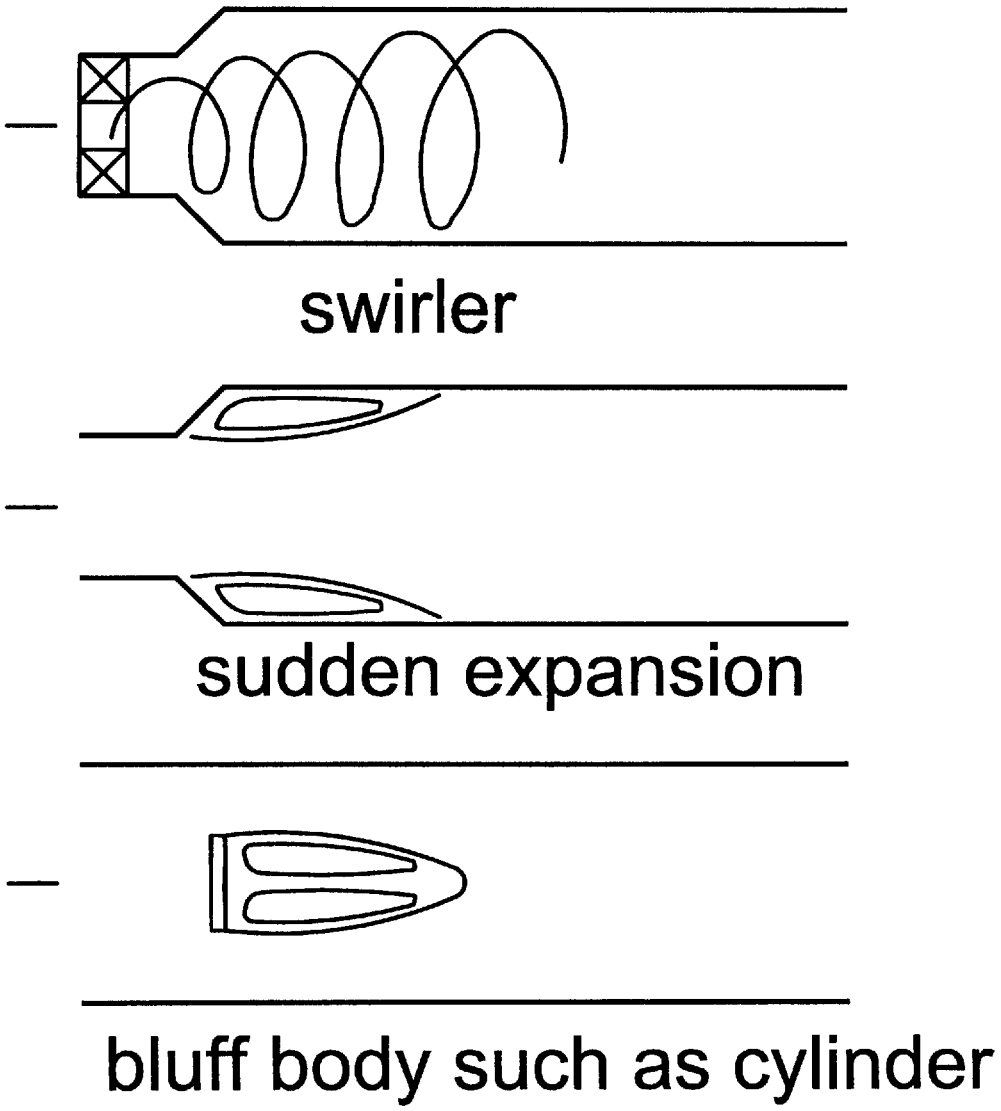
FIG. 1*a* illustrates prior art flameholder devices.
Figure 1B:
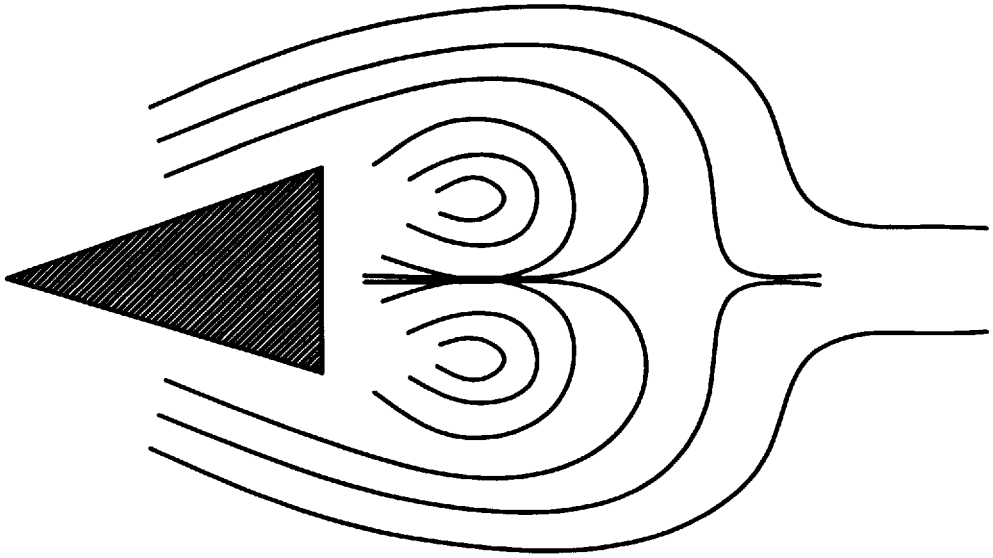
FIG. 1*b* illustrates a prior art V-gutter type flameholder.

1 . . . the air stream
2 . . . the channel with the boundary of the internal flow field or casing
3 . . . the twin-plate flameholder
4 . . . the arrangement of rotating shaft
5 . . . link plates
6 . . . . burner
7 . . . twin-plate flameholder
8 . . . link plates
9 . . . pivoted shaft
10 . . . control valve
11 . . . flow meter
12 . . . pressure guage
13 . . . control valve
14 . . . flowmeter
15 . . . casing
16 . . . spray bar
17 . . . small tube
18 . . . slit of twin-plate flameholder
19 . . . igniter
20 . . . flame
21 . . . burning substance
22 . . . twin-plate flameholder
23 . . . incinerator
24 . . . air stream
25 . . . large size residues
26 . . . flameholder
27 . . . incinerator wall
28 . . . transition section
29 . . . twin-plate flameholder
30 . . . link plates
31 . . . pivoted shaft
32 . . . burner

DETAILED DESCRIPTION OF THE DRAWINGS

This invention proposes a new design of a twin-plate flameholder to be used in an afterburner, industrial burner and incinerators. The flameholder consists of two separated plates with limited length linked together through a suitable arrangement, in which, the two plates feature a certain overlap and a slit at the overlap portion. When stream passes through this flameholder and slit stream introduced between the twin plates, an "S" shaped flow structure is formed behind the twin plate flameholder so as to create a stable and well mixed air-fuel recirculation zone. Moreover, a small fuel injection device can be provided in the slit area for introducing a small portion of fuel to control the local fuel distribution. FIG. 1C is a section view of this set-up. The important parameters of this type of flameholder are; width of plate;

angle of attack (AOA);

overlap length (O);

slit size (S); and extension at the trailing edge (D). Test results shows that the slit size should neither be too small nor too large, an optimum size of O is several times S.

Experimental works has been carried by inventors with similar set-up as stated above and the results of several tests indicated:

Vortex flow motion formed an S-shaped flow structure within the recirculation zone behind the twin-plate flameholder.

The fuel concentration at the slit exit increases as the by-pass fuel increases. As a result, the local fuel concentration at slit exit increases, and that of the central line of the recirculation zone increases. That is to say, the small slit stream through the slit between the two plates of the twin-plate flameholder controls the local fuel distribution in the wake zone, and this in turn extends the ignition limits. The lean blow-out limit is also extended due to by-pass fuel injection. It turns out that this by-pass fuel injection can be taken as a control mechanism to enhance the flame stability limits of the twin-plate flameholder. It seems that this by-pass fuel injection provides a local high reaction layer to stabilize the combustion processes of the twin-plate flameholder.

The angle-of-attack (AOA) can be adjusted and controlled by rotating a shaft pivoted by the link plates of its both ends. In operation, the angle between the twin-plate flameholder and the direction of stream flow shall be adjusted. While afterburning is not required and the required pressure loss for flameholder is minimum, the AOA is zero, i.e. this bluff body is at the position in parallel with the direction of stream flow. At this position, its blockage is limited to the thickness of the plates and its drag is very little. On the contrary, while afterburning is required, ignition and combustion is to take place in the afterburner, it is required to keep the recirculation zone more stable and the flame in recirculation zone has a high stability, so that, by taking a limited amount of pressure loss, it is required to adjust and control the angular position of twin-plate flameholder in order to gain an optimum ignition and relight performance as well as a best combustion feature in the high altitude. For this type of control mechanism, it is well known in the field of aircraft engine that the concept in designing inlet guide vane can also be used for designing a control mechanism for twin-plate flameholder.

The twin plate flameholder can be placed into a combustion chamber of either cylindrical or rectangular shape without necessity to insert a transition section.

Figure 1C:
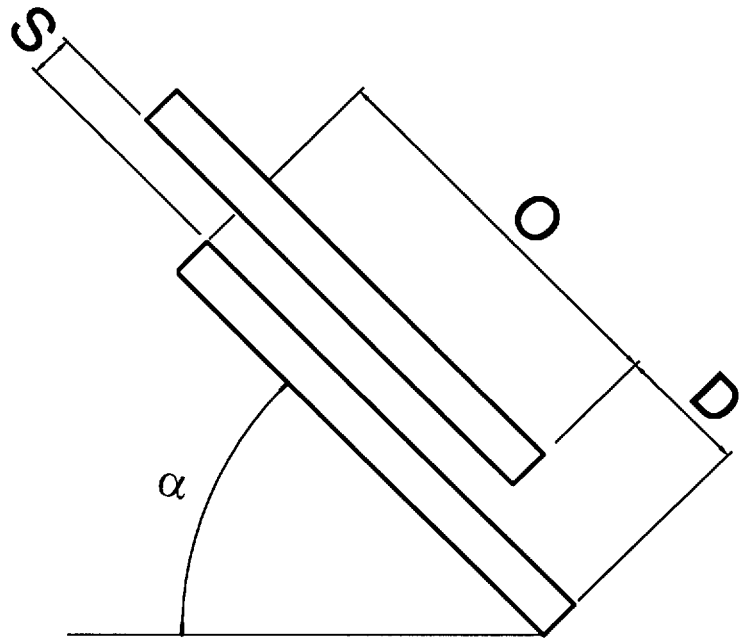
FIG. 1*c* illustrates a flameholder which embodies the features of the present invention.

Please now refer to FIG. 1 for the first embodiment of this invention. A twin-plate flameholder (3) is being used in a two dimensional internal flow field, in which, the air stream (1) with velocity "U" flows into the channel with the boundary of the internal flow field or casing (2). The twin-plate flameholder (3) is secured on the side wall of this casing by the arrangement of rotating shaft (4) fixed to link plates (5) at both ends of the twin-plate flameholder and is rotatable. The slit of this twin-plate flameholder is facing the direction of the stream flow (1), so that, a small portion of air stream (1) comes into the recirculation zone behind the twin-plate flameholder. This twin-plate flameholder can rotate to any angular position relative to the direction of stream flow. When its angular position is zero degree, i.e., in parallel with the direction of stream flow, it is not in a position to holding flame and its drag is minimum. When this twin-plate flameholder rotates to an angular position as 90 degrees in relative to the stream direction, it has the best feature in holding a flame in stable and its drag is maximum.

Figure 2:
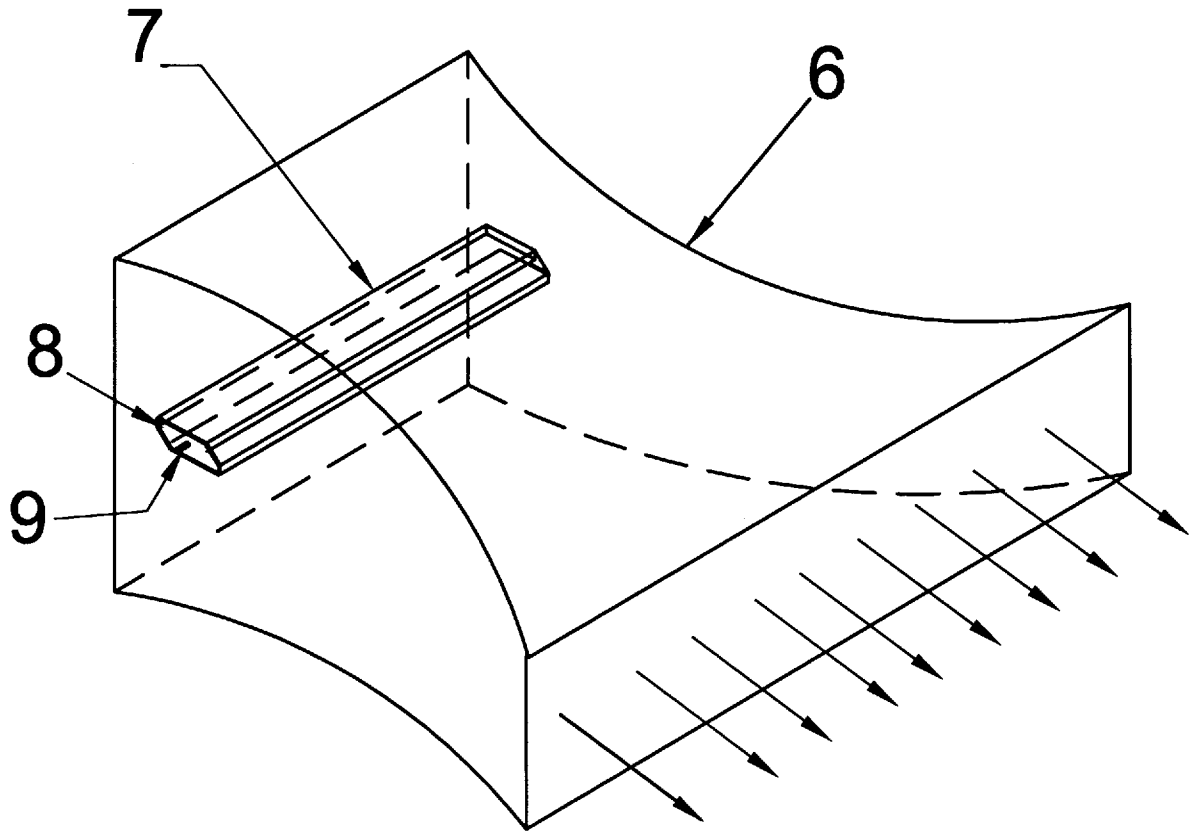
FIG. 2 is a view showing the twin-plate flameholder of this invention being placed inside of a rectangular cross section having a two dimensional flow.

Please refer to FIG. 2 for the second embodiment of this invention. The twin-plate flameholder is being placed in a burner (6) of rectangular shape. This burner has an aspect ratio variation along the flow direction. The structure of twin-plate flameholder could just well meet the requirement of this rectangular burner. The twin-plate flameholder (7) is secured at its both ends through link plates (8) and pivoted shaft (9) which is for adjusting its AOA.

Figure 3:
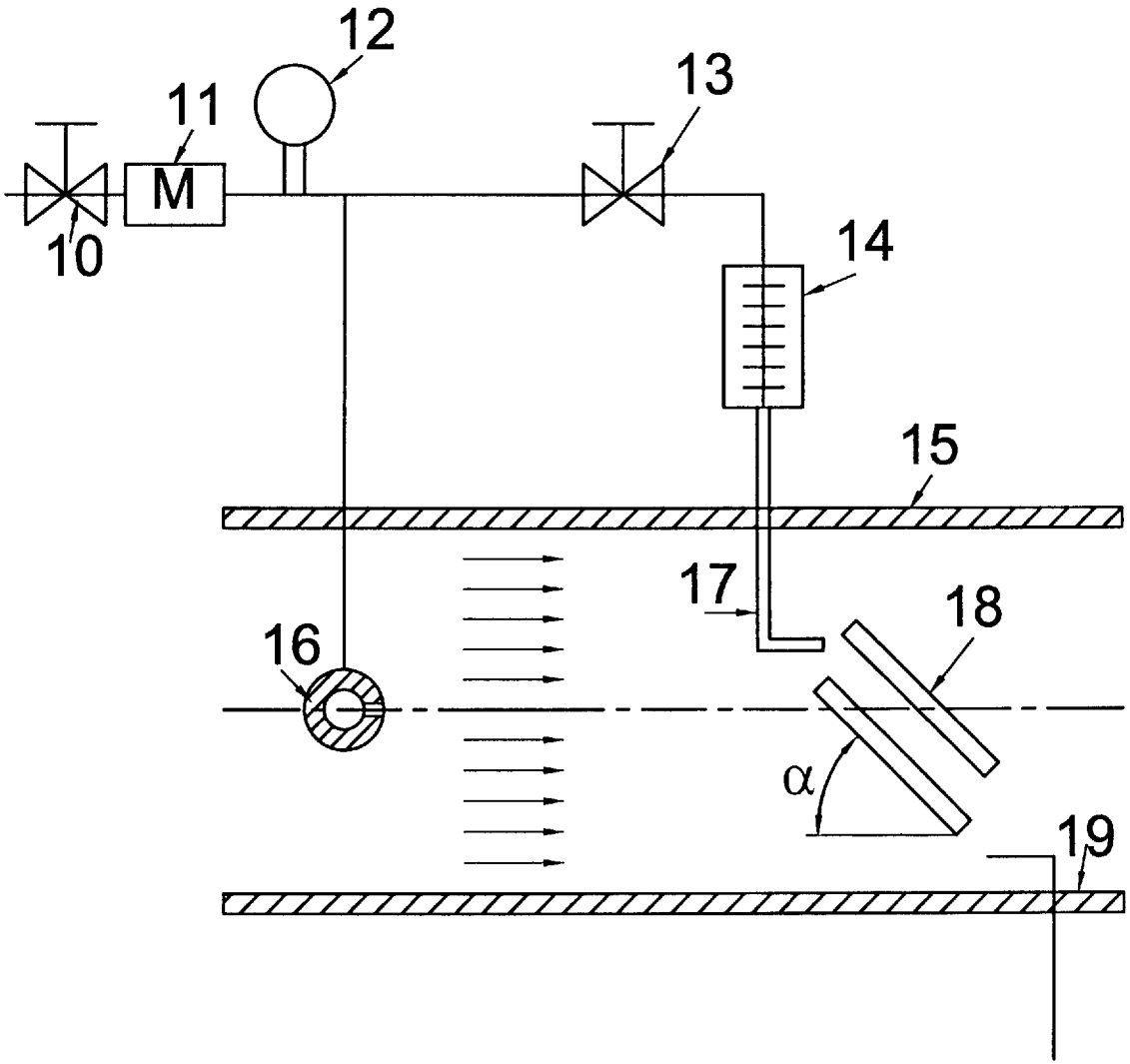
FIG. 3 is a diagram illustrating the twin-plate flameholder of this invention in an embodiment where a small portion of fuel is to be injected into a wake zone through a slit by using a by-pass fuel injection and a control mechanism to adjust the local fuel distribution.

Please refer to FIG. 3 for the third embodiment of this invention, which demonstrates the special arrangement of the by-pass fuel injection device injecting a small portion of fuel into the slit of twin-plate flameholder to control the local fuel concentration in the recirculation zone. As a result, its control of the local air-fuel ratio has a great effect on ignition and blow-out limits as well as combustion efficiency. The set-up comprises an internal flow bounded by a casing (15). Fuel insertion by a spray bar (16) via a control valve (10), a flow meter (11) and a pressure gauge (12). For maintaining the same amount of air-fuel ratio, a manifold and a control valve (13) are provided upstream of the spray bar to guide a small portion of fuel into the slit of twin-plate flameholder (18) via another flowmeter (14) and small tube (17), and ignition by means of igniter (19).

Figure 4:
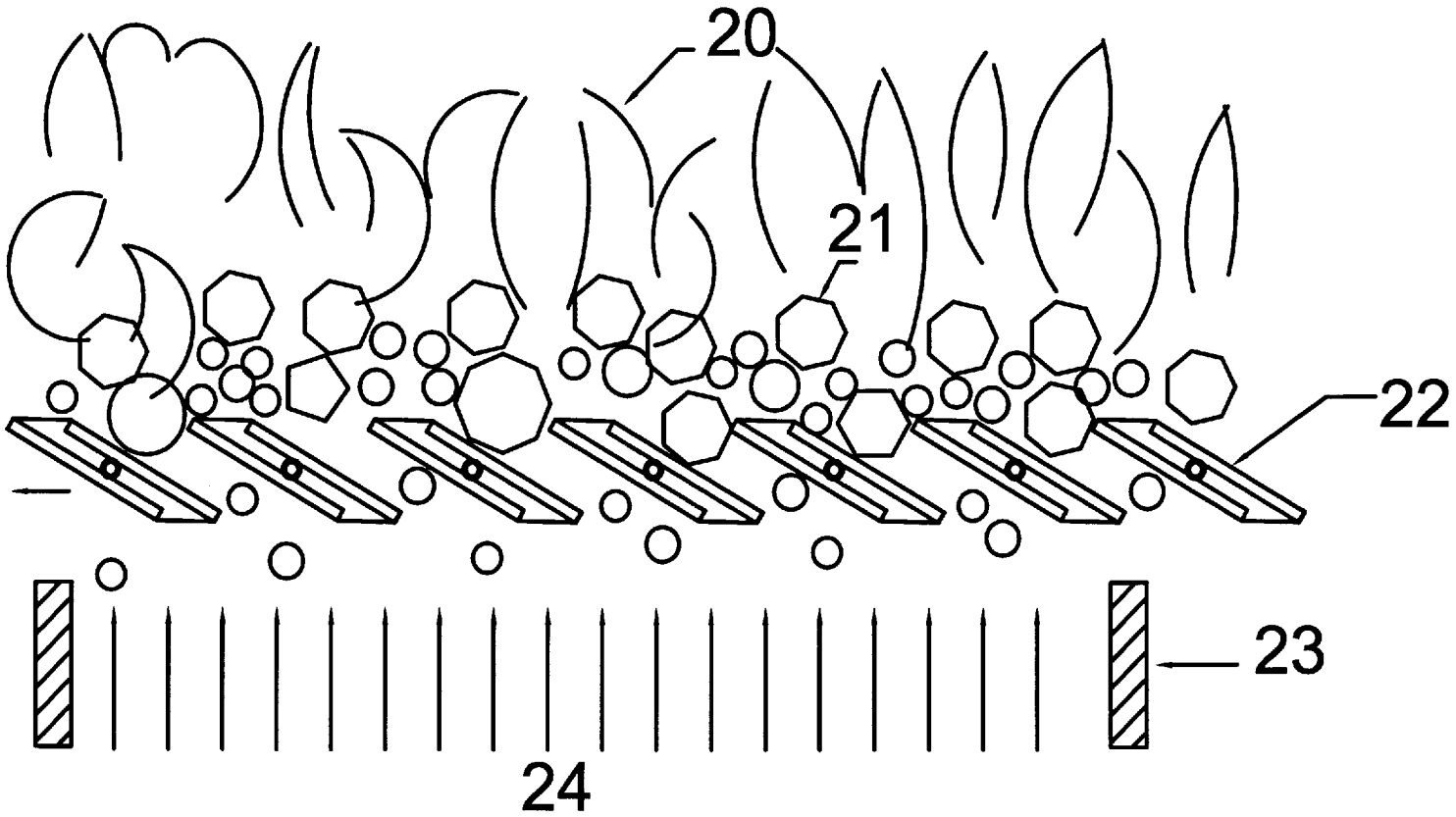
FIG. 4 is a view showing the twin-plate flameholder of this invention being applied to an industrial burner, in which, this flameholder also functions as a conveyer.
Figure 5:
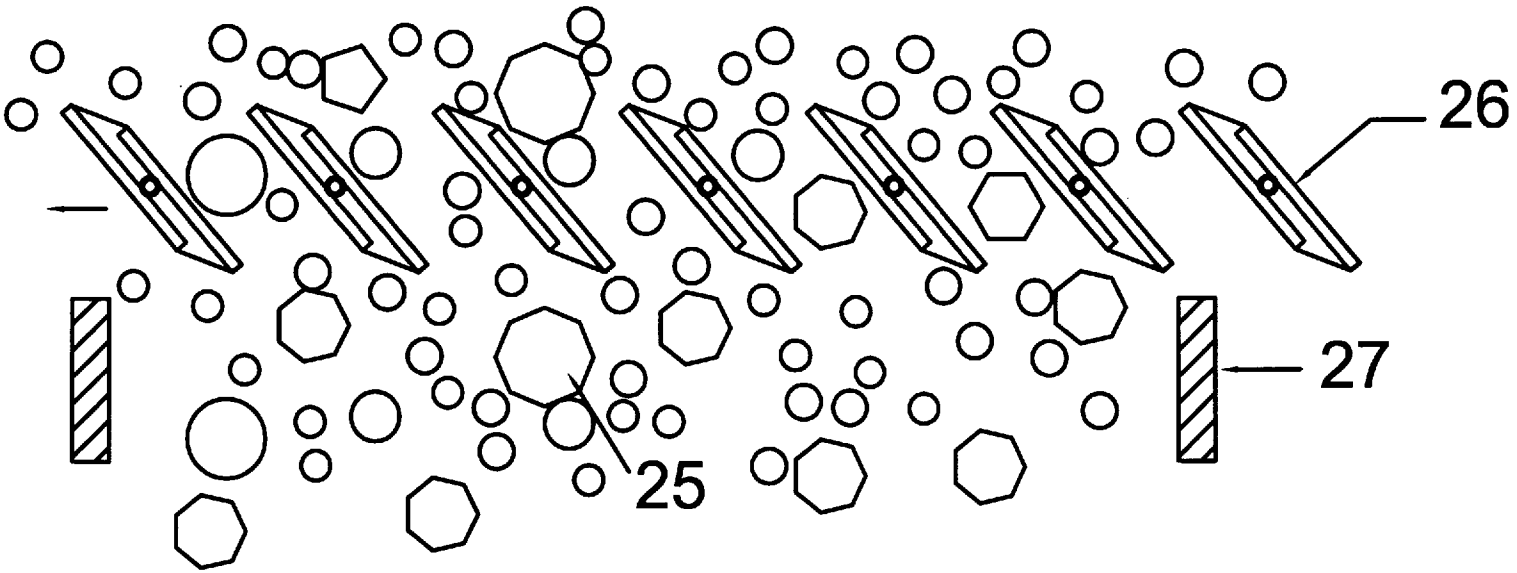
FIG. 5 is similar to FIG. 4, but also shows the twin-plate flameholder of this invention adjusting its AOA and being used for discharging ash and incidental clog.

Please refer to FIG. 4 and FIG. 5 for the fourth embodiment of this invention, which demonstrate the twin-plate flameholder as a conveyer and also its function for discharging ash. The combustion chamber is defined by the walls of an incinerator (23). Air stream (24) goes upwards. The twin-plate flameholder (22) carries burning substance (21) to the central area of the chamber, and continuously generates the flame (20). However, there are residues in large size (25) left on the flameholder (26) in incinerator (27). FIG. 5 shows the flameholder (26) dumping those large size residues into the incinerator by adjusting its AOA.

Figure 6:
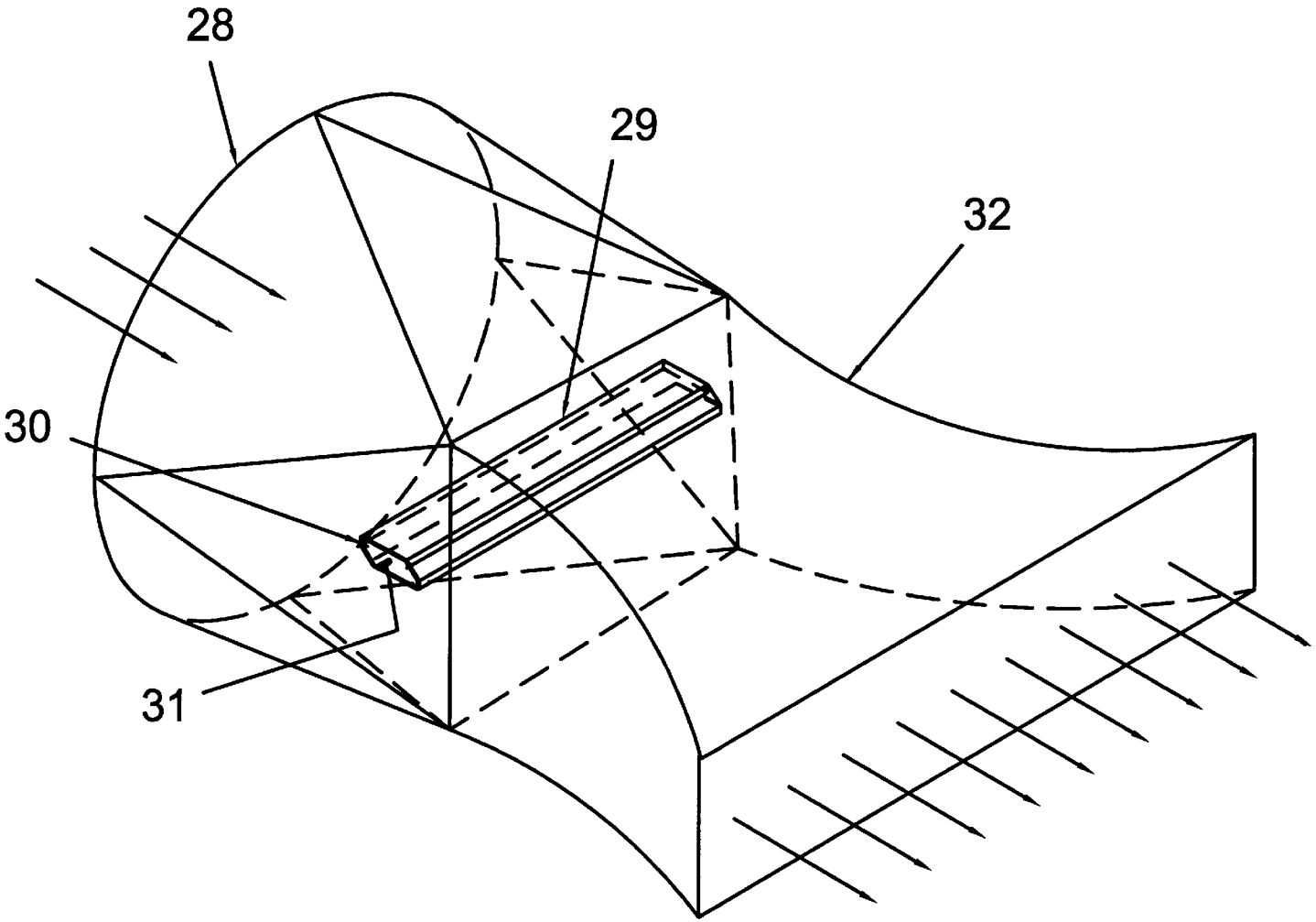
FIG. 6 is a view showing the twin-plate flameholder of this invention installed in the transition section in cooperation with a two dimensional nozzle in order to shorten the length.

Please refer to FIG. 6 for fifth embodiment of this invention which illustrates that a design of a transition section (28) is placed between a round inlet and rectangular outlet connecting with a rectangular burner (32), and this transition section (28) is also acting as port of combustion chamber. The twin-plate flameholder (29) is well fitted to this type of flow field. The said flameholder is secured by link plates (30) at both ends and has a pivoted shaft (31) for adjusting its AOA.

The characters and advantages of the twin-plate flameholder according to this invention can be summarized as the following:

A. Characters:

1. The twin-plate flameholder is constructed with two plates to replace the previously suggested single-plate and features a certain overlap between two plates with a slit at the overlap portion. It turns out that a small portion of the air and fuel flows through the slit between two plates will result in significant modification in the aerodynamic flow structure and local fuel distribution to enhance the mechanism for flame holding.

2.Through a suitable link arrangement and rotating device, the two plates shall be able to rotate integrally for adjusting the AOA.

3. A small portion of fuel can be introduced through a slit between the plates to control the local fuel distribution even at the same amount of fuel injection.

B. Advantages:

1. When afterburning is not required, the twin-plate flameholder can be adjusted to zero degree position for reducing pressure loss of the said flameholder, and, in turn, to enhance the normal thrust force of a turbine engine.
2. With by-pass fuel injected into the recirculation zone through the slit between two plates, the combustion chamber will obtain a much better flame stability as well as its ignition and blow-out limits.
3. With a twin-plate flameholder provided in the afterburner of a turbine engine, its flame stability in high altitude shall be improved and the flight envelope for the aircraft as well as operational range for industrial incinerator is extended.
4. The slit stream of air and fuel flow into the recirculation zone will also enhance its combustion efficiency.
5. A small portion of fuel injected into the slit can be used to control the local fuel distribution and air-fuel ratio.
6. The twin-plate flameholder is applicable in a combustion chamber for cylindrical and rectangular and even a transition section, which a conventional V-gutter flameholder is not easily adapted.
7. When twin-plate flameholder used in an industrial incinerator, it can also be used for discharging ash and incidental clog.
8. In favor of cost saving.
9. In favor of reducing the engine's total weight.

As many apparently different embodiments of this invention can be made without departing from the spirit and scope thereof, it is to be understood that the invention is not limited to the special embodiments thereof except as defined in the appended claims.

What is claimed is:

1. A flame holding system, comprising:

a casing having a flow chamber defined therein for an internal flow stream;

a fuel spray bar disposed in said casing;

a fuel injector disposed in said casing;

an igniter disposed in said casing;

a first control valve;

a first flow meter in communication with said first control valve and said fuel spray bar;

a second control valve;

a second flow meter in communication with said second control valve and said fuel injector; and a flame holder including a first plate member, a second plate member and link means for linking said first plate member to said second plate member such that a slit is defined between said first and said second plate members, wherein, said fuel injector is positioned relative to said slit such that fuel injected therefrom is received in said slit of said flame holder during flame holding operation.

2. The flame holding system as defined by claim 1, wherein:

said first and said second plate members are relatively positioned such that an overlapping portion and an extending portion are defined thereby.

3. The flame holding system as defined in claim 2, further comprising:

pivot means for pivoting and angling said twin plate flame holder in relation to said flow stream to adjust said twin plate flame holder, said pivot means being engaged with said link means.

4. The flame holding system as defined in claim 3, further comprising:

control means for controlling said pivot means.

5. The flame holding system as defined by claim 4, wherein:

said first plate member is parallel with said second plate member.

6. The flame holding system as defined by claim 5, wherein:

a length of said overlapping portion is two times greater than said slit.

7. The flame holding system as defined by claim 6, wherein:

said twin plate flameholder is adjusted by said pivot means at an angle which allows a portion of said flow stream to be received in said slit.

8. The flame holding system as defined by claim 1, wherein:

said link means includes a first link plate, said first link plate being connected to a first end of said first plate member and a first end of said second plate member.

9. The flame holding system as defined by claim 8, wherein:

said link means further includes a second link plate, said second link plate being connected to a second end of said first plate member and a second end of said second plate member.

10. The flame holding system as defined by claim 9, wherein:

said first link plate is disposed opposite said second link plate.

11. The flame holding system as defined by claim 10, further comprising:

pivot means for pivoting and angling said twin plate flame holder in relation to said flow stream to adjust said twin plate flame holder, said pivot means being engaged with said first link plate and said second link plate.

12. The flame holding system as defined by claim 11, wherein:

said first and said second plate members are relatively positioned such that an overlapping portion and an extending portion are defined thereby.

13. The flame holding system as defined by claim 12, further comprising:

control means for controlling said pivot means.

14. The flame holding system as defined by claim 13, wherein:

said first plate member is parallel with said second plate member.

15. The flame holding system as defined by claim 14, wherein:

a plurality of said twin plate flame holders are interconnected to form a conveyor apparatus.

16. The flame holding system as defined by claim 14, wherein:

said twin plate flameholder is adjusted by said pivot means at an angle which allows a portion of said flow stream to be received in said slit.

17. The flame holding system as defined by claim 1, wherein:

said flame holder further includes pivot means for pivoting and angling said twin plate flame holder in relation to said flow stream to adjust said twin plate flame holder, and control means for controlling said pivot means, said pivot means being engaged with said link means.

18. The flame holding system as defined by claim 17, wherein:

said first and said second plate members are relatively positioned such that an overlapping portion and an extending portion are defined thereby, a length of said overlapping portion is two time greater than said slit, said first plate member is parallel with said second plate member, and said flameholder is adjusted by said pivot means at an angle which allows a portion of said flow stream to be received in said slit.

* * * * *